US008479357B2

(12) United States Patent
Santoemma et al.

(10) Patent No.: US 8,479,357 B2
(45) Date of Patent: Jul. 9, 2013

(54) MOQUETTE CARPET CLEANING MACHINE OPERABLE IN PULL-BACK MODE

(75) Inventors: Nicola Santoemma, Milan (IT); Massimiliano Santoemma, Milan (IT)

(73) Assignee: Santoemma S.R.L., Pero (Milan) (IT)

( * ) Notice: Subject to any disclaimer, the term of this patent is extended or adjusted under 35 U.S.C. 154(b) by 737 days.

(21) Appl. No.: 12/082,914

(22) Filed: Apr. 15, 2008

(65) Prior Publication Data

US 2008/0256745 A1 Oct. 23, 2008

(30) Foreign Application Priority Data

Apr. 20, 2007 (IT) ..... MI2007A0836

(51) Int. Cl.
*A47L 5/34* (2006.01)

(52) U.S. Cl.
USPC ..... 15/354; 15/356

(58) Field of Classification Search
USPC ..... 15/383, 300.1, 354, 361, 356, 368
See application file for complete search history.

(56) References Cited

U.S. PATENT DOCUMENTS

| | | | | |
|---|---|---|---|---|
| 2,823,412 | A * | 2/1958 | Kirby | 15/354 |
| 3,722,024 | A * | 3/1973 | Schmitz | 15/339 |
| 4,342,132 | A * | 8/1982 | Fromknecht | 15/339 |
| 6,357,076 | B1 * | 3/2002 | Lee | 15/354 |
| 2005/0091783 | A1 * | 5/2005 | Sepke et al. | 15/320 |
| 2007/0251050 | A1 * | 11/2007 | Harsh et al. | 15/352 |

* cited by examiner

*Primary Examiner* — Robert Scruggs
(74) *Attorney, Agent, or Firm* — Hedman & Costigan, P.C.; James V. Costigan

(57) ABSTRACT

A moquette carpet cleaning machine (10) having a machine body (11) with main rear wheels (12) and a suction mouth (14) placed at the front of the machine body. A support (19) with an auxiliary wheel is attached to the machine body (11). At least one of the main wheels (12), the suction mouth (14), the auxiliary wheel (16) and the support (19) being movable with respect to the machine body (11) between at least a first position (A) and a second (B) position such that, the auxiliary wheel (16) is in the first position (A), the suction mouth (14) is maintained against the ground (20). When the auxiliary wheel is in the second relative position (B), the suction mouth (14) is maintained in a position that is substantially raised from the ground (20).

8 Claims, 2 Drawing Sheets

MOQUETTE CARPET CLEANING MACHINE OPERABLE IN PULL-BACK MODE

The present invention refers to an improved moquette carpet cleaning machine operable in pull-back mode.

The moquette carpet cleaning machines of compact type, so-called self-contained, are composed of a machine body containing a tank for the clean water and a recovery tank.

The clean water, possibly with the addition of detergent, is sprayed on the moquette carpet, sprayed and finally suctioned by a washing group.

In particular, the water or the water and detergent solution is sprayed by means of nozzles placed near the soil and the liquid is suctioned by the tank and thrust under pressure by a spray pump. The suction mouth is placed in contact with the moquette carpet and serves to suction, from the moquette carpet, the sprayed liquid together with the dirt removed from the moquette carpet.

The washing group additionally often has a rotating brush that is actuated by an electric motor.

For moquette carpet cleaning machines of self-contained type, the washing group is placed under the body of the machine itself, near the ground.

By moving the entire machine, the operator cleans the moquette carpet strips below the washing group. The self-contained machines are in particular classified in two types according to whether they can be handled by the operator: the "pull-back" type, in which the operator pulls the machine backward, and the "push-forward" type, in which the operator pushes the machine forward.

The first are recommended for small areas, the second for medium and large areas.

In the pull-back machines, the suction mouth is placed on the front part of the machine. In the backward motion, therefore, the moquette is sprayed, brushed and finally suctioned by the suction mouth.

In the push-forward machines, the mouth is placed on the rear part of the machine, so that in the forward motion, the moquette carpet is first sprayed, then brushed and finally suctioned by the rear mouth.

Hence, a pull-back machine, which is normally pulled back by the handle, if thrust forward from the side opposite the handle, would work like a push-forward machine having the handle in the position opposite the actual position.

There are self-contained machines on the market having a foldable handle, so that the same machine can be used both in pull-back and push-forward mode.

There are also carpet cleaning machines provided with two suction mouths: one placed on the front part and one on the rear part with respect to the operator position. These machines can also function in both modes.

In particular, in such machines, when the machine is pulled back, the front suction mouth carries out the drying, while when the machine is pushed forward, the drying is carried out by the rear mouth.

Therefore, in the present text, with pull-back machines reference will be made both to carpet cleaning machines conceived for functioning only in pull-back mode and to pull-back functioning modes of machines that can function in both modes.

The pull-back machines allow cleaning a strip under the body of the machine itself, pulling the machine backward.

At the end of every strip, the operator must slightly raise the front part of the machine, keeping the suction mouth raised, and bring the machine to the start point of the subsequent strip to be cleaned.

Indeed, the suction mouth for moquette carpets, in contact with the moquette carpet itself, opposes the attempt to push the machine forward and have it slide without raising the mouth.

The operator is then forced to raise the mouth of the machine by levering on the wheels of the machine placed at the rear of the same, pushing the machine forward, maintaining it balanced for several meters, and then releasing the machine so to once again rest the suction mouth on the moquette carpet.

During the forward movement, the machine is only set on the rear wheels. Therefore, the operator must sustain the weight of the machine by keeping it balanced on such wheels.

Moreover, with moquette carpet machines known today, it is not possible to carry out a pre-brushing, in general useful before washing. To such end, dedicated machinery is necessary.

The object of the present invention is that of overcoming the drawbacks mentioned above and in particular that of making a moquette carpet cleaning machine operable in pull-back mode that is easy for the operator to use.

In particular, the object of the present invention is that of providing a moquette carpet cleaning machine operable in pull-back mode that reduces the work of the operator in the phase in which the machine must be thrust forward, in order to be positioned at the start of a subsequent moquette carpet strip.

A further object of the present invention is that of making a moquette carpet cleaning machine operable in pull-back mode that permits carrying out a pre-brushing of the moquette carpet with the same machine then used to carry out the washing.

These and other objects according to the present invention are achieved by making a moquette carpet cleaning machine operable in pull-back mode as set forth in claim 1.

Further characteristics of the machine are the object of the dependent claims.

The characteristics and advantages of a moquette carpet cleaning machine operable in pull-back mode according to the present invention will be clearer from the following exemplifying and non-limiting description, referred to the attached schematic drawings in which.

Figure 1:
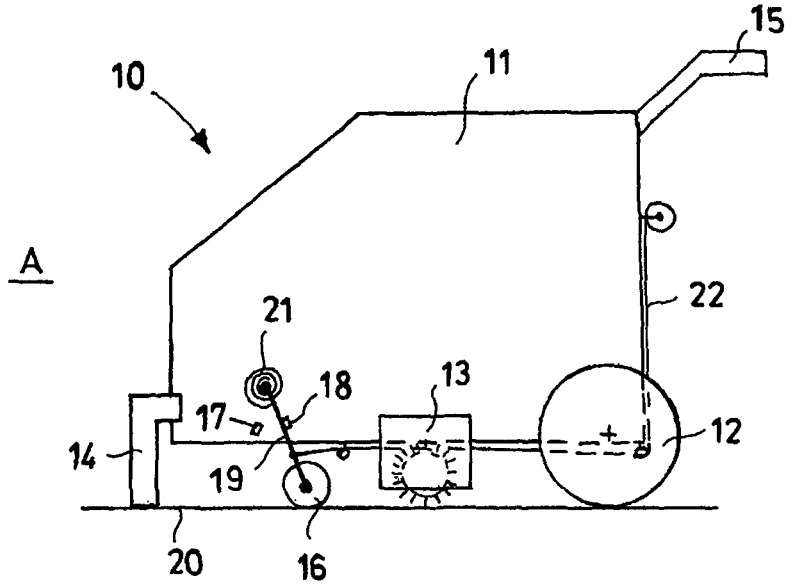
FIG. 1 is a side elevation schematic view of a preferential but not limiting embodiment of the moquette carpet cleaning machine operable in pull-back mode according to the present invention in operative washing configuration.

With reference to the figures, a moquette carpet cleaning machine operable in pull-back mode is shown, indicated with 10 overall.

The pull-back machine 10 according to the invention comprises a machine body 11 substantially composed of a tank for water, or for the water and detergent solution, and a recovery tank.

The machine body 11 is moreover provided with a handle 15 on its upper part and with main rear wheels 12 on its lower part, with a brush group 13 and a suction mouth 14 for moquette carpets placed on the front part of the machine 10.

According to the present invention, the pull-back machine is moreover provided with at least one auxiliary wheel 16.

Such wheel 16 is preferably mounted on support means 19, which in turn are bound to the machine body 11.

In the illustrated embodiment, the machine body 11, the main wheels 12 and the suction mouth 14 form a single, rigid body, while the support means 19 of the auxiliary wheel 16 are bound in a movable manner with respect to the machine body 11.

In particular, in such embodiment, the support means 19, and therefore also the auxiliary wheel 16, are movable with respect to the machine body 11 between at least one first A and at least one second B relative position, respectively corresponding to a first configuration in which the pull-back machine 10 is operative for the washing and a second configuration in which the pull-back machine is stably maintained raised in its front part.

If the pull-back machine 10 is found in operative washing position, i.e. the auxiliary wheel 16 is in a first position A adherent to the ground 20 and closer to the machine body 11, as shown in FIG. 1, the suction mouth 14 is in contact with the moquette carpet 20.

By pulling the machine back, it is possible to suction in a normal manner.

Figure 2:
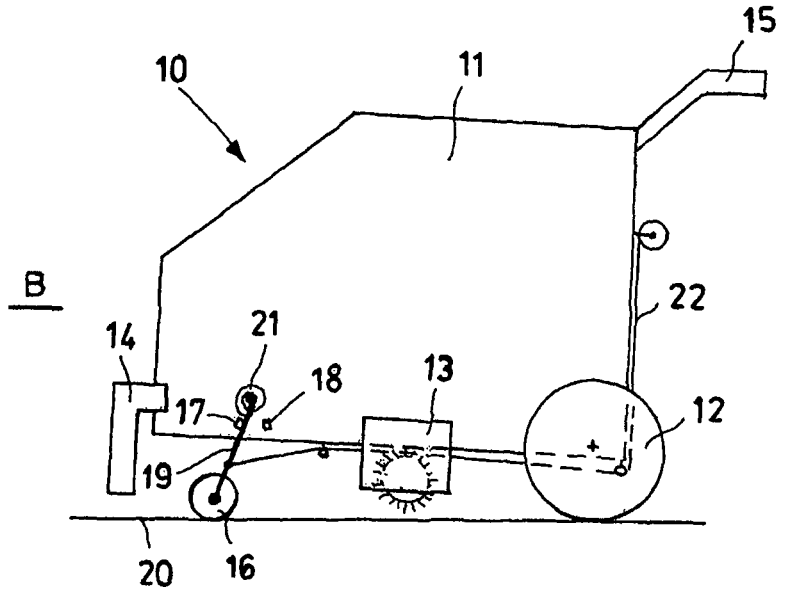
FIG. 2 is a side elevation schematic view of the moquette carpet cleaning machine of FIG. 1 in raised front position.
Figure 3:
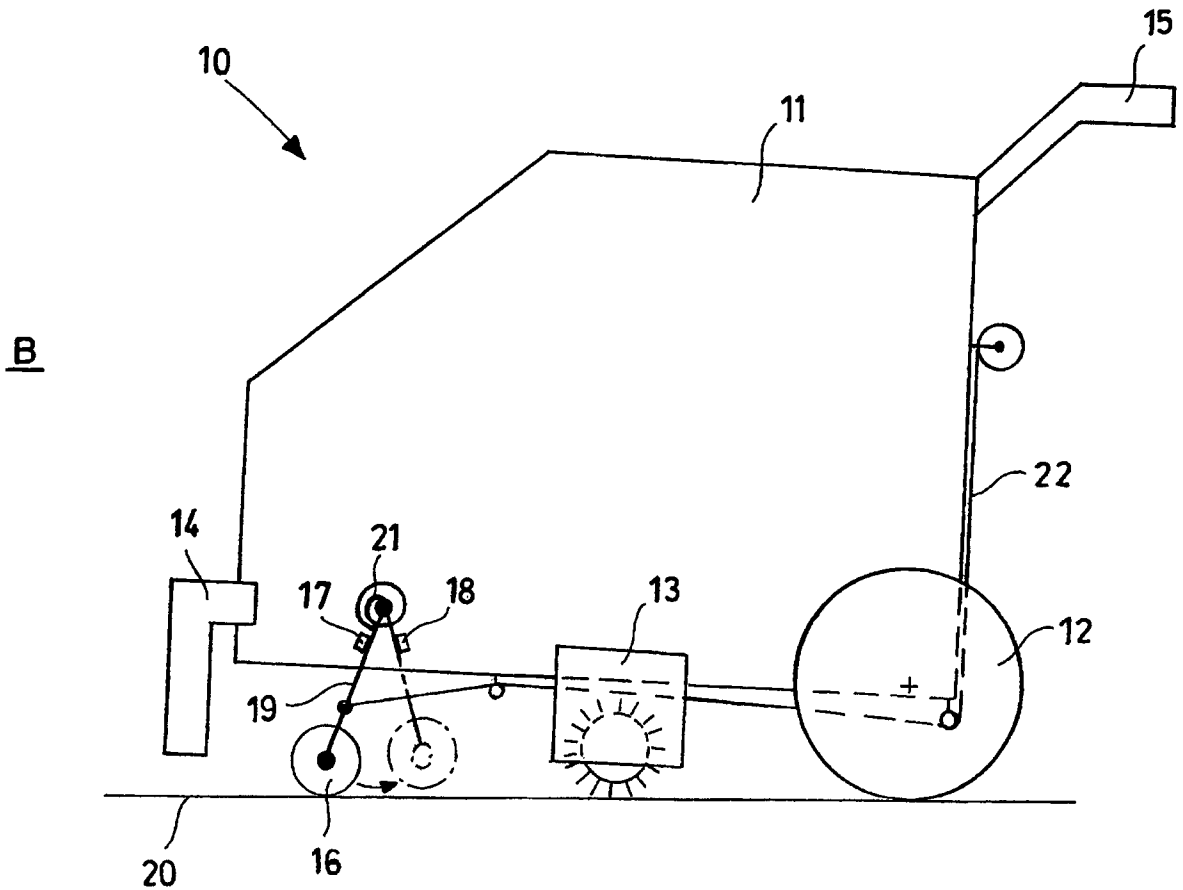
FIG. 3 is a side elevation schematic view of the moquette carpet cleaning machine of FIGS. 1 and 2 in raised front position and pre-brushing operative configuration.

On the other hand, in the raised configuration shown in FIGS. 2 and 3, the pull-back machine 10 can rest on the main wheels 12 and on the at least one auxiliary wheel 16, now placed in a second position B adhering to the ground 20 but further from the machine body 11, therefore stably keeping itself in a front-raised position in which the suction mouth 14 does not touch or just touches the moquette carpet 20 without pressing thereon.

In such second position B, the binding reactions of the main 12 and auxiliary 16 wheels compensate for the weight force of the pull-back machine 10.

The pull-back machine 10 can be thrust forward by resting on the main 12 and auxiliary 16 wheels and the suction mouth 14 does not touch the moquette carpet 20.

In particular, the operator is no longer obligated to keep the pull-back machine 10 balanced on the main wheels 12.

In the illustrated preferential embodiment, the support means 19 are made by means of a rod 19 that has one end hinged on a fixed point of the machine body 11 and on which an auxiliary wheel 16 is mounted.

The rotation of the rod 19 is limited by end stops 17,18, in such a manner that the auxiliary wheel 16 can oscillate between the first A and the second B position with regard to the machine body 11, as previously defined.

The support means 19 of the at least one auxiliary wheel 16 can also be made in other entirely equivalent modes.

For example, the support means can be made as a movable toggle mechanism between a first substantially compressed configuration and second substantially unfolded configuration, which respectively correspond to a first A and a second B position of the machine body 11 with regard to the auxiliary wheel 16, such that in the first position A, the suction mouth 14 rests on the moquette carpet 20, while, in the second position B, the suction mouth 14 is raised from the moquette carpet 20. In an alternative embodiment, the support means 19 of the auxiliary wheel 16 are bound in a rigid manner with respect to the machine body 11, while the auxiliary wheel 16 is movable with respect to the same 11.

In such case, the support means 19 can be made as a rectilinear guide bound without degrees of freedom to the machine body 11, along which guide the auxiliary wheel 16 is free to slide between two end stops, thus being able to assume two positions A and B with regard to the machine body 11.

Also in this embodiment, the two positions A and B are characterised in that, in the first position A, the suction mouth 14 rests on moquette carpet 20, while in the second position B, the suction mouth 14 is raised from the moquette carpet 20.

In alternative embodiments, the main wheels 12 and/or suction mouth 14 have at least one degree of freedom with respect to the machine body 11, it being movable between at least a first relative position with respect to the machine body 11 in which the suction mouth 14 is adherent to the ground 20, and at least one second position with regard to the machine body 11 in which the suction mouth 14 is practically raised from the ground 20.

For example, the suction mouth 14 can be hinged to the machine body 11, it being able to rotate between said first A and second B relative position.

In such case, when the suction mouth 14 is found in the second relative position, the machine 10 stably rests on the main wheels 12 and on the at least one auxiliary wheel 16.

In one such embodiment, the support means 19 of the auxiliary wheel 16 can possibly be connected in a rigid manner to the machine body 11.

On the other hand, the suction mouth 14 can be rigid with respect to the machine body 11, while the main wheels 12 are articulated with respect to the machine body 11. Also in such case, the support means 19 of the auxiliary wheel 16 are connected not necessarily with degrees of freedom, but in a rigid manner to the machine body 11.

In a preferential embodiment, the raised configuration can also be used for carrying out a pre-brushing of the moquette carpet 20, by moving the machine 10 both forward and back without the suction mouth 14 forming an obstacle to the movement of the machine 10.

To this end, the brush group 13 can be lowered from the machine body 11 to come into contact with the moquette carpet, as shown in FIG. 3.

It is also possible to adjust the pressure of the rotating brush 13 in order to obtain the desired brushing pressure.

Suitable constraining means 21 operate on the means 12,14,16,19 that are movable with regard to the machine body, which while permitting means 12,14,16,19 movement with regard to the machine body 11 between the two relative positions A and B, in the absence of other forces operating on such movable means 12,14,16,19 tend to keep them in their second relative position B.

In the illustrated embodiment, the constraining means 21 are made by means of a spring that pushes the auxiliary wheel 16 towards the end stop 17 related to the second position B.

Such auxiliary wheel 16 therefore remains in its second position B even if maintained raised with respect to the ground 20, for example by rotating the pull-back machine 10 back and pivoting on the main wheels 12.

Such stable balanced position B is maintained by the at least one auxiliary wheel 16 even if the pull-back machine 10 loads more on the same 16, for example by rotating the pull-back machine 10 ahead by pivoting on the at least one auxiliary wheel 16, or by increasing the weight of the machine 10 by loading more water or solution in the respective tank.

Finally, such auxiliary wheel 16 is maintained in its second position B even during the forward or backward movement of the pull-back machine 10.

On the other hand, the auxiliary wheel 16 is maintained in its first position A by the weight of the pull-back machine 10. Therefore, for forces not excessively high exerted on the handle 15 of the machine, and for not-excessive discontinuities of the ground 20, the auxiliary wheel 16 remains in its first position A and in particular is not moved into the second position B.

In order to bring the movable means 12,14,16,19 back, with respect to the machine body 11, from their second relative position B to their first relative position A corresponding to the operative washing configuration of the pull-back machine 10, control means 22 are provided for.

Such control means 22 actuate a forced displacement of the movable means 12,14,16,19 by exerting a suitable force adapted to oppose the force exerted by the constraining means 21.

The control means 22 are preferably placed near the handle 15 of the pull-back machine 10.

In the particular illustrated embodiment, the opposing force is transmitted to the support means 19 and therefore also to the auxiliary wheel 16 by means of a brake wire 22.

Alternatively, control means 22 can be made as a pedal or electric actuation.

The functioning of the pull-back machine 10 according to the invention is described below with reference to the embodiment illustrated in the figures.

When the pull-back machine 10 is found in the operative washing configuration, with the suction mouth 14 in contact with the moquette carpet 20, the auxiliary wheel 16 touches the ground 20, such that the auxiliary wheel 16 is prevented from moving towards its second position B.

By slightly raising the pull-back machine 10, the auxiliary wheel 16 tends instead to be moved towards its second position B under the return force action exerted by the spring 21.

By sufficiently raising the pull-back machine 10, the auxiliary wheel 16 loses contact with the ground 20 and is free to be moved into the second position B. This second position B being a stable balanced position for the auxiliary wheel 16, once in this position such wheel 16 tends to remain there, even if the operator releases the pull-back machine 10. Indeed, the weight force acting on the auxiliary wheel 16, the reaction of the ground 20 and the reaction forces between the wheel 16 and the machine body 11 are not capable of making the wheel 16 return into the first position A.

The second position B is such that when the auxiliary wheel 16 is found in such position B, the machine 10 rests both on the main wheels 12 and on the auxiliary wheels 16 and the suction mouth 14 is maintained raised from the ground 20.

The operator is therefore capable of pushing the pull-back machine 10 forward by exerting on the same a single horizontal force, and in particular not having to exert any force to keep the pull-back machine 10 balanced.

In order to bring the auxiliary wheel 16 back to its first position A related to the operative washing configuration, the operator actuates the control means 22 that indirectly act on the auxiliary wheel 16 through the support means 19.

It suffices that such control means 22 bring the auxiliary wheel 16 at least beyond the stability limit, so that the weight of the pull-back machine 10 forces the auxiliary wheel 16 into its first position A, i.e. in the machine configuration in which the suction mouth 14 is adherent to the moquette carpet 20.

From the above description, the characteristics of the machine, object of the present invention, are clear, as are the related advantages.

In addition to the main wheels, the brush group and the suction mouth for moquette carpets, the pull-back machine according to the invention is provided with at least one further auxiliary wheel.

This auxiliary wheel acts in a convenient manner when the machine must be thrust forward, sustaining part of the weight of the machine itself.

In such a manner, it is no longer necessary for the operator to sustain the weight of the machine, as normally occurs in the known machines, maintaining it balanced on only the rear wheels.

During backward motion, the machine must instead clean the moquette carpet with the suction mouth in close contact with the moquette carpet.

Therefore, the auxiliary wheels assume a position with regard to the machine body such to not be an impediment for the contact of the suction mouth with the moquette carpet during work.

It is clear, finally, that the device as conceived is susceptible to numerous modifications and variants, all part of the invention; moreover, all details can be substituted with technically equivalent elements.

In practice, the materials used, as well as size, can be of any type according to the technical needs.

The invention claimed is:

1. Moquette carpet cleaning machine (10) operable in pull-back mode comprising:

a machine body (11) having a front and a rear wherein said rear is provided with main rear wheels (12) and a suction mouth (14) placed at the front, and support means (19) connected to said machine (10), wherein said support means (19) support at least one auxiliary wheel (16) movable with respect to said machine body (11) towards the rear of said machine body (11) to lower said machine body (11) into at least a first position (A) and movable towards the front of said machine body (11) to raise said machine into at least a second position (B) such that, when said machine body (11) is in said first position (A), said suction mouth (14) is maintained in contact with the ground (20), and when said machine body (11) is in said second position (B), said suction mouth (14) is maintained substantially raised from said ground (20) wherein constraining means (21) that comprise a spring act on said support means (19) or said at least one auxiliary wheel (16) to bring and stably maintain said machine body (11) said second position (B), said constraining means being activated by raising said machine body (11) by rotating the machine (10) so that said machine (10) pivots on the rear wheels (12) wherein said at least one auxiliary wheel (16) is moved by control means (22) that are adapted to oppose the action of said constraining means (21) in order to lower said machine body (11) into said first position (A), wherein said control means (22) are a brake wire connected to said at least one auxiliary wheel (16) or said support means (19).

2. Moquette carpet cleaning machine (10) according to claim 1, which comprises a movable brush group (13), that can be brought into contact with said ground (20), even when said machine body (11) is in said second position (B).

3. Moquette carpet cleaning machine (10) according to claim 1, wherein said support means (19) are a rectilinear guide along which said auxiliary wheel (16) is free to slide between two end stops, and said constraining means (21) maintain said auxiliary wheel (16) at one of said two end stops.

4. Moquette carpet cleaning machine (10) according to claim 1, wherein said main wheels (12) are movable with respect to said machine body (11).

5. Moquette carpet cleaning machine (10) according to claim 1, wherein said suction mouth (14) is movable with respect to said machine body (11).

6. Moquette carpet cleaning machine (10) according to claim 1, wherein said support means (19) are movable with respect to said machine body (11).

7. Moquette carpet cleaning machine (10) according to claim 6, wherein said support means (19) are a rod having a first end and a second end wherein said first end is hinged to said machine body (11) and said auxiliary wheel (16) is mounted at said second end, the rotation of said rod (19) being constrained between two end stops (17,18), and said constraining means (21) maintain said rod (19) at one of said two end stops (17,18).

8. Moquette carpet cleaning machine (10) according to claim 6, wherein said support means (19) are a toggle mechanism movable between a first substantially compressed configuration and a second substantially unfolded configuration, and said constraining means (21) maintain said support means (19) in one of said first configuration or said second configuration.

* * * * *